US011085169B2

(12) United States Patent
Matsuyama et al.

(10) Patent No.: US 11,085,169 B2
(45) Date of Patent: Aug. 10, 2021

(54) WORK EQUIPMENT CONTROL DEVICE AND WORK MACHINE

(71) Applicant: Komatsu Ltd., Tokyo (JP)

(72) Inventors: Toru Matsuyama, Tokyo (JP); Jin Kitajima, Tokyo (JP); Yuki Shimano, Tokyo (JP)

(73) Assignee: Komatsu Ltd., Tokyo (JP)

( * ) Notice: Subject to any disclaimer, the term of this patent is extended or adjusted under 35 U.S.C. 154(b) by 166 days.

(21) Appl. No.: 16/099,291

(22) PCT Filed: Nov. 29, 2017

(86) PCT No.: PCT/JP2017/042786
§ 371 (c)(1),
(2) Date: Nov. 6, 2018

(87) PCT Pub. No.: WO2018/101319
PCT Pub. Date: Jun. 7, 2018

(65) Prior Publication Data

US 2019/0194905 A1 Jun. 27, 2019

(30) Foreign Application Priority Data

Nov. 30, 2016 (JP) ..... JP2016-233280

(51) Int. Cl.
*E02F 3/43* (2006.01)
*E02F 9/20* (2006.01)
(Continued)

(52) U.S. Cl.
CPC ..... *E02F 3/439* (2013.01); *E02F 3/32* (2013.01); *E02F 3/43* (2013.01); *E02F 9/20* (2013.01); *E02F 9/2041* (2013.01); *E02F 9/265* (2013.01)

(58) Field of Classification Search
CPC .. E02F 5/02; G06T 17/05; G06T 2207/30248; G06K 9/00791; G01N 33/24; G01C 21/00; G01C 21/20; G01C 21/34; G01C 21/3407; G01C 21/3415; G01C 21/343; G01C 21/3469; G01C 21/3476; G01C 21/3453; G01C 21/3638; G01C 21/3644; G05D 2201/02; G05D 2201/0201; G05D 2201/0202; G05D 2201/0207;
(Continued)

(56) References Cited

U.S. PATENT DOCUMENTS

| | | | |
|---|---|---|---|
| 5,598,648 | A | 2/1997 | Moriya et al. |
| 5,933,346 | A | 8/1999 | Brabec et al. |
| 2015/0367851 | A1 | 12/2015 | Yoshizawa et al. |

FOREIGN PATENT DOCUMENTS

| | | | |
|---|---|---|---|
| CN | 104995052 | A | 10/2015 |
| JP | 03-066838 | A | 3/1991 |

(Continued)

*Primary Examiner* — Anthony R Jimenez
(74) *Attorney, Agent, or Firm* — Locke Lord LLP

(57) ABSTRACT

A work equipment control device includes a bucket posture-determining unit, a working plane-determining unit, and a bucket control unit. The bucket posture-determining unit determines an angle of a bucket in global coordinates. The working plane-determining unit determines an angle of a working plane in the global coordinates indicating a target shape of an excavation object of work equipment. The bucket control unit controls the bucket such that a difference between the angle of the bucket and the angle of the working plane maintains a uniform angle.

22 Claims, 8 Drawing Sheets

(51) Int. Cl.
*E02F 9/26* (2006.01)
*E02F 3/32* (2006.01)

(58) Field of Classification Search
CPC ..... G05D 2201/021; G05D 2201/0212; G05D 3/00; G05D 3/12; G05D 1/00; G05D 1/0011; G05D 1/0033; G05D 1/0274; G05D 1/0088; G05D 1/0231; G05D 1/0238; G05D 1/0246; G05D 1/0219; G05D 1/02; G05D 1/0268; G05D 1/0276; G05D 1/0278; G05D 1/20; G05D 1/0044
USPC ..... 701/23, 25
See application file for complete search history.

(56) References Cited

FOREIGN PATENT DOCUMENTS

| | | | |
|---|---|---|---|
| JP | 10-088608 | A | 4/1998 |
| JP | 10-292420 | A | 11/1998 |

WORK EQUIPMENT CONTROL DEVICE AND WORK MACHINE

CROSS REFERENCE TO RELATED APPLICATIONS

This application is related to co-pending application: "WORK EQUIPMENT CONTROL DEVICE AND WORK MACHINE" filed even date herewith in the name of Toru Matsuyama as a national phase entry of PCT/JP2017/042772, which application is assigned to the assignee of the present application and is incorporated by reference herein.

TECHNICAL FIELD

The present invention relates to a work equipment control device and a work machine.

Priority is claimed on Japanese Patent Application No. 2016-233280, filed Nov. 30, 2016, the content of which is incorporated herein by reference.

BACKGROUND ART

As disclosed in Patent Literature 1, a technology is known in which the angle of work equipment is uniformly maintained in order to perform straight excavation.

CITATION LIST

Patent Literature

Patent Literature 1

Japanese Unexamined Patent Application, First Publication No. Hei 3-66838

SUMMARY OF INVENTION

Technical Problem

According to the technology disclosed in Patent Literature 1, one working plane can be suitably formed by uniformly maintaining the angle of work equipment. On the other hand, in a case in which a plurality of working planes are formed while straddling an inflection point where the angles of working planes vary (a point where working planes having gradients different from each other are connected to each other), when a bucket reaches the inflection point, an operator needs to operate a switch to deactivate control of maintaining the angle of work equipment and to perform an operation such that the work equipment is set at a suitable angle, and then the operator needs to operate the switch again to activate control of maintaining the angle of the work equipment.

An object of an aspect of the present invention is to provide a work equipment control device and a work machine, which can suitably maintain the angle of work equipment at the time of excavation work of a plurality of target excavation ground shapes including an inflection point and having angles different from each other without an explicit operation performed by an operator.

Solution to Problem

According to a first aspect of the present invention, a work equipment control device is provided which controls a work machine equipped with work equipment including a bucket.

The control device includes a bucket posture-determining unit that determines an angle of the bucket, a working plane-determining unit that determines an angle of a working plane indicating a target shape of an excavation object of the work equipment, and a bucket control unit that controls the bucket such that the difference between the angle of the bucket and the angle of the working plane maintains a uniform angle.

According to a second aspect of the present invention, a work machine is provided, including work equipment that includes a bucket, and the control device according to the aspects described above.

Advantageous Effects of Invention

According to at least one of the aspects described above, the work equipment control device can suitably maintain the angle of a bucket at the time of excavation work of a plurality of target excavation ground shapes including an inflection point and having angles different from each other without an explicit operation performed by an operator.

DESCRIPTION OF EMBODIMENTS

First Embodiment

Hereinafter, an embodiment will be described with reference to the drawings.

Hydraulic Shovel

Figure 1:
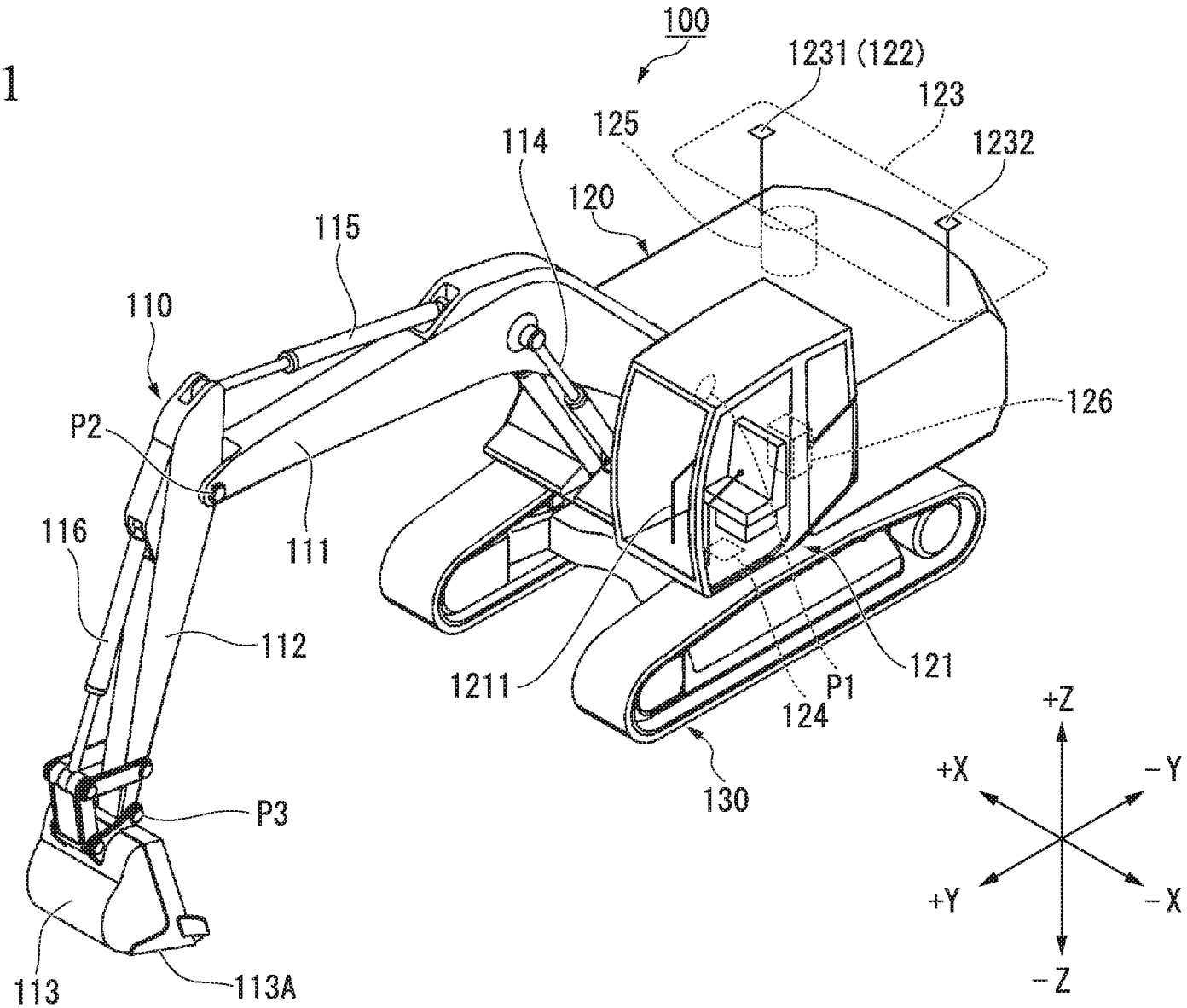
FIG. 1 is a perspective view illustrating a configuration of a hydraulic shovel according to a first embodiment.

FIG. 1 is a perspective view illustrating a configuration of a hydraulic shovel according to a first embodiment. In the first embodiment, a hydraulic shovel 100 will be described as an example of a work machine. A work machine according to another embodiment is not necessarily the hydraulic shovel 100.

The hydraulic shovel 100 includes work equipment 110 operated by a hydraulic pressure, a vehicle body 120 as an upper swiveling body supporting the work equipment 110, and a traveling apparatus 130 as a lower traveling body supporting the vehicle body 120.

The work equipment 110 includes a boom 111, an arm 112, a bucket 113, a boom cylinder 114, an arm cylinder 115, and a bucket cylinder 116.

The boom 111 is a strut supporting the arm 112 and the bucket 113. A proximal end portion of the boom 111 is attached to a front portion of the vehicle body 120 via a pin P1.

The arm 112 joins the boom 111 and the bucket 113 to each other. A proximal end portion of the arm 112 is attached to a distal end portion of the boom 111 via a pin P2.

The bucket 113 includes a blade for excavating earth, sand, and the like, and a container for transporting excavated earth and sand. The bucket 113 includes a bucket bottom surface 113A extending to a rear end side of the blade. A proximal end portion of the bucket 113 is attached to a distal end portion of the arm 112 via a pin P3.

The boom cylinder 114 is a hydraulic cylinder for operating the boom 111. A proximal end portion of the boom cylinder 114 is attached to the vehicle body 120. A distal end portion of the boom cylinder 114 is attached to the boom 111.

The arm cylinder 115 is a hydraulic cylinder for driving the arm 112. A proximal end portion of the arm cylinder 115 is attached to the boom 111. A distal end portion of the arm cylinder 115 is attached to the arm 112.

The bucket cylinder 116 is a hydraulic cylinder for driving the bucket 113. A proximal end portion of the bucket cylinder 116 is attached to the arm 112. A distal end portion of the bucket cylinder 116 is attached to the bucket 113.

The vehicle body 120 includes an operator's cab 121 to be boarded by an operator. The operator's cab 121 is provided in the front of the vehicle body 120 and on the left side of the work equipment 110. In the first embodiment, a front-rear direction is defined as a positive Y-direction and a negative Y-direction, a right-left direction is defined as a negative X-direction and a positive X-direction, and an up-down direction is defined as a positive Z-direction and a negative Z-direction, based on the operator's cab 121. An operation device 1211 for operating the work equipment 110 is provided inside the operator's cab 121. Hydraulic oil is supplied to the boom cylinder 114, the arm cylinder 115, and the bucket cylinder 116 in accordance with the operation amount of the operation device 1211.

Control System of Hydraulic Shovel

Figure 2:
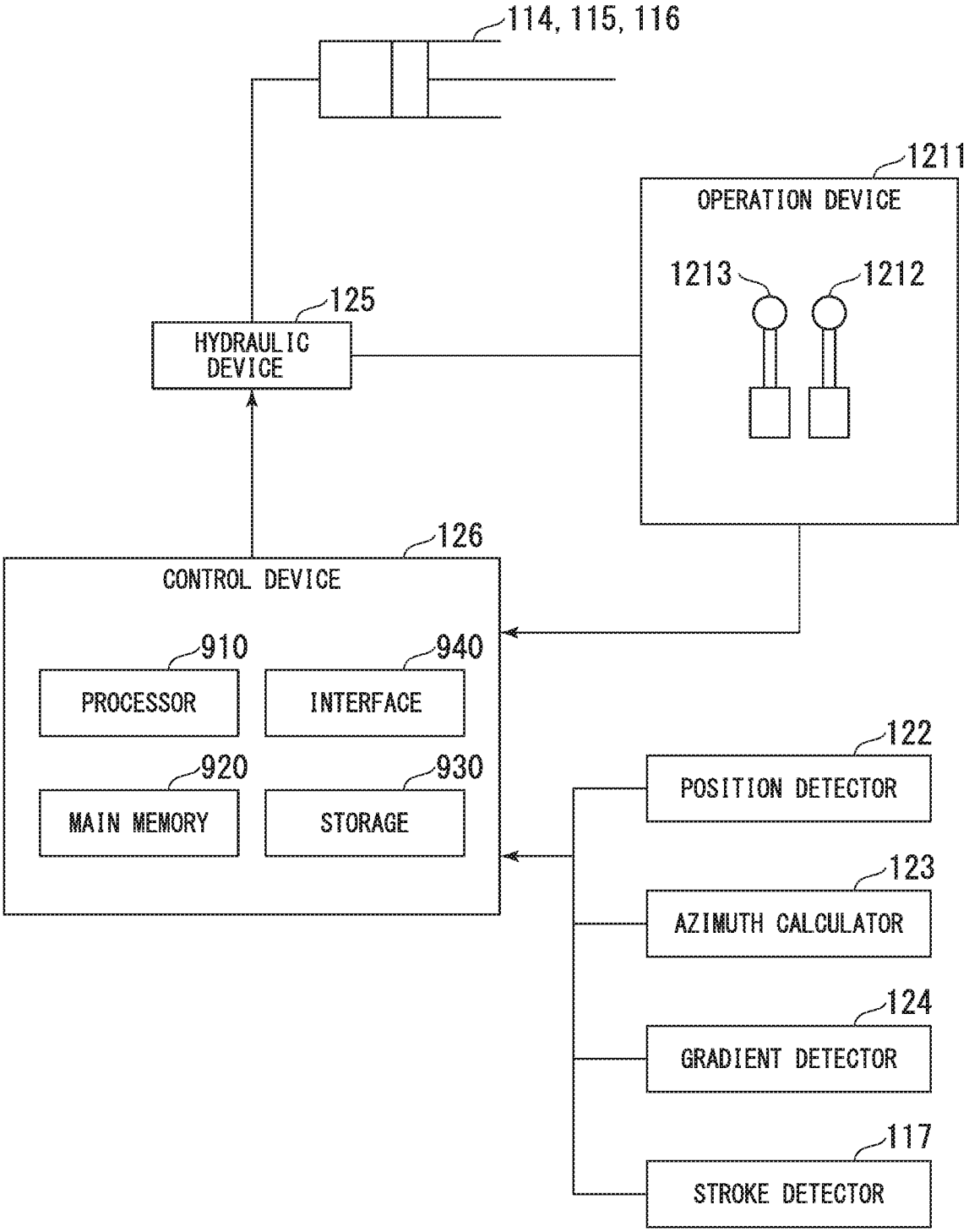
FIG. 2 is a schematic block diagram illustrating a configuration of a control system of the hydraulic shovel according to the first embodiment.

FIG. 2 is a schematic block diagram illustrating a configuration of a control system of the hydraulic shovel according to the first embodiment.

The hydraulic shovel 100 includes a stroke detector 117, the operation device 1211, a position detector 122, an azimuth calculator 123, and a gradient detector 124.

The stroke detector 117 detects the length of a stroke of each of the boom cylinder 114, the arm cylinder 115, and the bucket cylinder 116. Accordingly, a control device 126 (which will be described below) can detect the postural angle of the work equipment 110 based on the length of a stroke of each of the boom cylinder 114, the arm cylinder 115, and the bucket cylinder 116. That is, in the first embodiment, the stroke detector 117 is an example of means for detecting a postural angle of the work equipment 110. On the other hand, another embodiment is not limited thereto. As means for detecting a postural angle of the work equipment 110, in place of the stroke detector 117 or in combination with the stroke detector 117, an angle detector such as a rotary encoder or a level gauge may be used.

The operation device 1211 includes a right side operation lever 1212 provided on the right side of the operator's cab 121, and a left side operation lever 1213 provided on the left side of the operator's cab 121. The operation device 1211 detects the operation amount of the right side operation lever 1212 in the front-rear direction and the right-left direction, and the operation amount of the left side operation lever 1213 in the front-rear direction and the right-left direction. Then, the operation device 1211 outputs an operation signal corresponding to the detected operation amount to the control device 126. A method of generating an operation signal by the operation device 1211 according to the first embodiment is a PPC method. The PPC method is a method in which a pilot hydraulic pressure generated by operating the right side operation lever 1212 and the left side operation lever 1213 is detected by a pressure sensor, and an operation signal is generated.

Specifically, an operation of the right side operation lever 1212 in a forward direction corresponds to a command for retraction of the boom cylinder 114 and a downward movement of the boom 111. An operation of the right side operation lever 1212 in a rearward direction corresponds to a command for extension of the boom cylinder 114 and an upward movement of the boom 111. An operation of the right side operation lever 1212 in the right direction corresponds to a command for retraction of the bucket cylinder 116 and dumping of the bucket 113. An operation of the right side operation lever 1212 in the left direction corresponds to a command for extension of the bucket cylinder 116 and excavation of the bucket 113. An operation of the left side operation lever 1213 in the forward direction corresponds to a command for extension of the arm cylinder 115 and excavation of the arm 112. An operation of the left side operation lever 1213 in the rearward direction corresponds to a command for retraction of the arm cylinder 115 and dumping of the arm 112. An operation of the left side operation lever 1213 in the right direction corresponds to a command for swiveling of the vehicle body 120 to the right. An operation of the left side operation lever 1213 in the left direction corresponds to a command for swiveling of the vehicle body 120 to the left.

The position detector 122 detects the position of the vehicle body 120. The position detector 122 includes a first receiver 1231 which receives a positioning signal from an artificial satellite constituting a global navigation satellite system (GNSS). The position detector 122 detects the position of a representative point of the vehicle body 120 in global coordinates based on a positioning signal received by the first receiver 1231. The global coordinates are coordinates having a specific point (for example, a position of a GNSS reference station provided on a worksite) on the ground as a reference point. Examples of the GNSS include a global positioning system (GPS).

The azimuth calculator 123 calculates the azimuth in which the vehicle body 120 is directed. The azimuth calculator 123 includes the first receiver 1231 and a second receiver 1232 receiving a positioning signal from an artificial satellite constituting the GNSS. The first receiver 1231 and the second receiver 1232 are installed at positions different from each other in the vehicle body 120. As a relationship between the detected installation position of the first receiver 1231 and the detected installation position of the second receiver 1232, the azimuth calculator 123 calculates the azimuth of the vehicle body 120 using the positioning signal received by the first receiver 1231 and the positioning signal received by the second receiver 1232.

The gradient detector 124 measures the acceleration and the angular speed of the vehicle body 120 and detects the gradient of the vehicle body 120 (for example, the pitch indicating a rotation about an X-axis, the yaw indicating a rotation about a Y-axis, and the roll indicating a rotation about a Z-axis) based on the measurement results. For example, the gradient detector 124 is installed on a lower surface of the operator's cab 121. For example, an inertial measurement unit (IMU) serving an inertial measurement device can be used as the gradient detector 124.

A hydraulic device 125 includes a hydraulic oil tank, a hydraulic pump, a flow rate control valve, and an electromagnetic proportional control valve. The hydraulic pump is driven by power of an engine (not illustrated) and supplies hydraulic oil to the boom cylinder 114, the arm cylinder 115, and the bucket cylinder 116 via a flow rate adjustment valve. The electromagnetic proportional control valve limits the pilot hydraulic pressure supplied from the operation device 1211, based on a control command received from the control device 126. The flow rate control valve has a rod-shaped spool and adjusts the flow rate of hydraulic oil to be supplied to the boom cylinder 114, the arm cylinder 115, and the bucket cylinder 116 depending on the position of the spool. The spool is driven due to the pilot hydraulic pressure adjusted by the electromagnetic proportional control valve. In an oil passage connected to the bucket cylinder 116, an electromagnetic proportional control valve limiting a basic pressure supplied by the hydraulic pump is provided in a mariner of being parallel to the electromagnetic proportional control valve limiting the pilot hydraulic pressure. Accordingly, the hydraulic shovel 100 can drive the bucket cylinder 116 by a hydraulic pressure higher than a pilot hydraulic pressure generated by the operation device 1211.

The control device 126 includes a processor 910, a main memory 920, a storage 930, and an interface 940.

A program for controlling the work equipment 110 is stored in the storage 930. Examples of the storage 930 include a hard disk drive (HDD) and a non-volatile memory. The storage 930 may be an internal medium directly connected to a bus of the control device 126 or may be an external medium connected to the control device 126 via the interface 940 or a communication line.

The processor 910 reads out the program from the storage 930, runs the program in the main memory 920, and executes processing in accordance with the program. In addition, the processor 910 secures a storage domain in the main memory 920 in accordance with the program. The interface 940 is connected to the stroke detector 117, the operation device 1211, the position detector 122, the azimuth calculator 123, the gradient detector 124, the electromagnetic proportional control valve of the hydraulic device 125, and other peripheral instruments, thereby giving and receiving a signal.

The program may be a program for realizing a part of functions exhibited by the control device 126. For example, the program may be a program for exhibiting a function in combination with another program which has already been stored in the storage 930 or in combination with another program loaded in another device.

The control device 126 determines the position of the bucket 113 by executing the program, based on the position detected by the position detector 122, the azimuth detected by the azimuth calculator 123, the gradient angle of the vehicle body 120 detected by the gradient detector 124, and the length of a stroke detected by the stroke detector 117. In addition, the control device 126 outputs a control command of the boom cylinder 114 and a control command of the bucket cylinder 116 to the electromagnetic proportional control valve of the hydraulic device 125 based on the determined position of the bucket 113 and the operation amount of the operation device 1211.

Posture of Work Equipment

Figure 3:
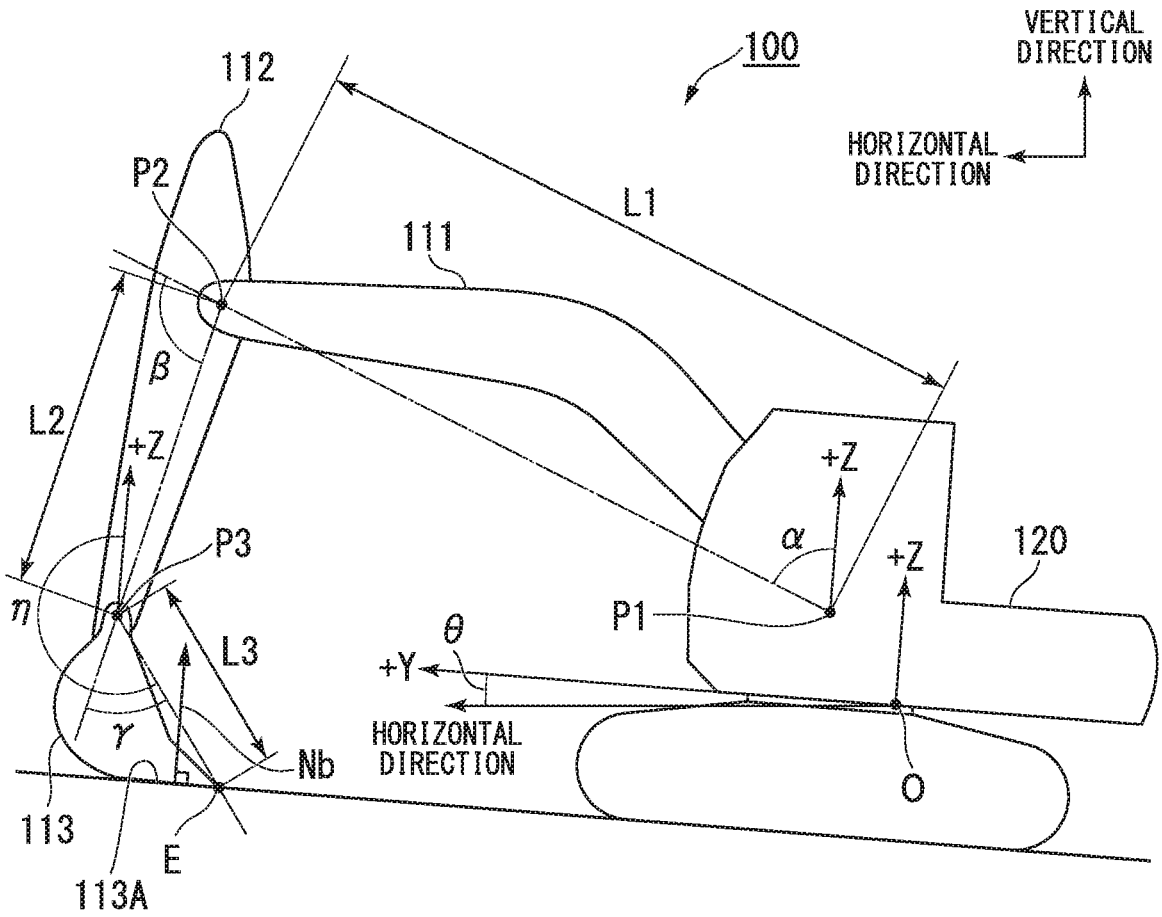
FIG. 3 is a view illustrating an example of a posture of work equipment.

FIG. 3 is a view illustrating an example of a posture of work equipment.

The control device 126 calculates the posture of the work equipment 110 and generates a control command of the work equipment 110 based on the posture thereof. Specifically, as the posture of the work equipment 110, the control device 126 calculates a postural angle $\alpha$ of the boom 111, a postural angle $\beta$ of the arm 112, a postural angle $\gamma$ of the bucket 113, and the positions of contour points of the bucket 113.

The postural angle $\alpha$ of the boom 111 is expressed as an angle formed by a half line extending from the pin P1 in an upward direction (positive Z-direction) of the vehicle body 120 and a half line extending from the pin P1 to the pin P2. Due to the gradient (pitch angle) $\theta$ of the vehicle body 120, the upward direction and a vertically upward direction of the vehicle body 120 do not necessarily coincide with each other.

The postural angle $\beta$ of the arm 112 is expressed as an angle formed by a half line extending from the pin P1 to the pin P2 and a half line extending from the pin P2 to the pin P3.

The postural angle $\gamma$ of the bucket 113 is expressed as an angle formed by a half line extending from the pin P2 to the pin P3 and a half line extending from the pin P3 to a blade tip E of the bucket 113.

Here, the sum of the postural angle $\alpha$ of the boom 111, the postural angle $\beta$ of the arm 112, and the postural angle $\gamma$ of the bucket 113 will be referred to as a postural angle $\eta$ of the work equipment 110. The postural angle $\eta$ of the work equipment 110 is equivalent to an angle formed by a half line extending from the pin P3 in the upward direction (positive Z-direction) of the vehicle body 120 and a half line extending from the pin P3 to the blade tip E of the bucket 113.

In addition, a vector which is orthogonal to the bucket bottom surface 113A and extending to an upper surface side will be referred to as a bottom surface normal vector Nb. The direction of the bottom surface normal vector Nb varies depending on the postural angle $\eta$ of the work equipment 110.

The positions of the contour points of the bucket 113 are obtained from dimension L1 of the boom 111, dimension L2 of the arm 112, dimension L3 of the bucket 113, the postural angle $\alpha$ of the boom 111, the postural angle $\beta$ of the arm 112, the postural angle $\gamma$ of the bucket 113, the contour shape of the bucket 113, the position of a representative point O of the vehicle body 120, and the positional relationship between the representative point O and the pin P1. The dimension L1 of the boom 111 is the distance from the pin P1 to the pin P2. The dimension L2 of the arm 112 is the distance from the pin P2 to the pin P3. The dimension L3 of the bucket 113 is the distance from the pin P3 to the blade tip E. For example, the positional relationship between the representative point O and the pin P1 is expressed as an X-coordinate position, a Y-coordinate position, and a Z-coordinate position of the pin P1 based on the representative point O. In addition, for example, the positional relationship between the representative point O and the pin P1 may be expressed as the distance from the representative point O to the pin P1, a gradient of a half line extending from the representative point O to the pin P1 in an X-axis direction, and a gradient of a half line extending from the representative point O to the pin P1 in a Y-axis direction.

Control Device of Hydraulic Shovel

Figure 4:
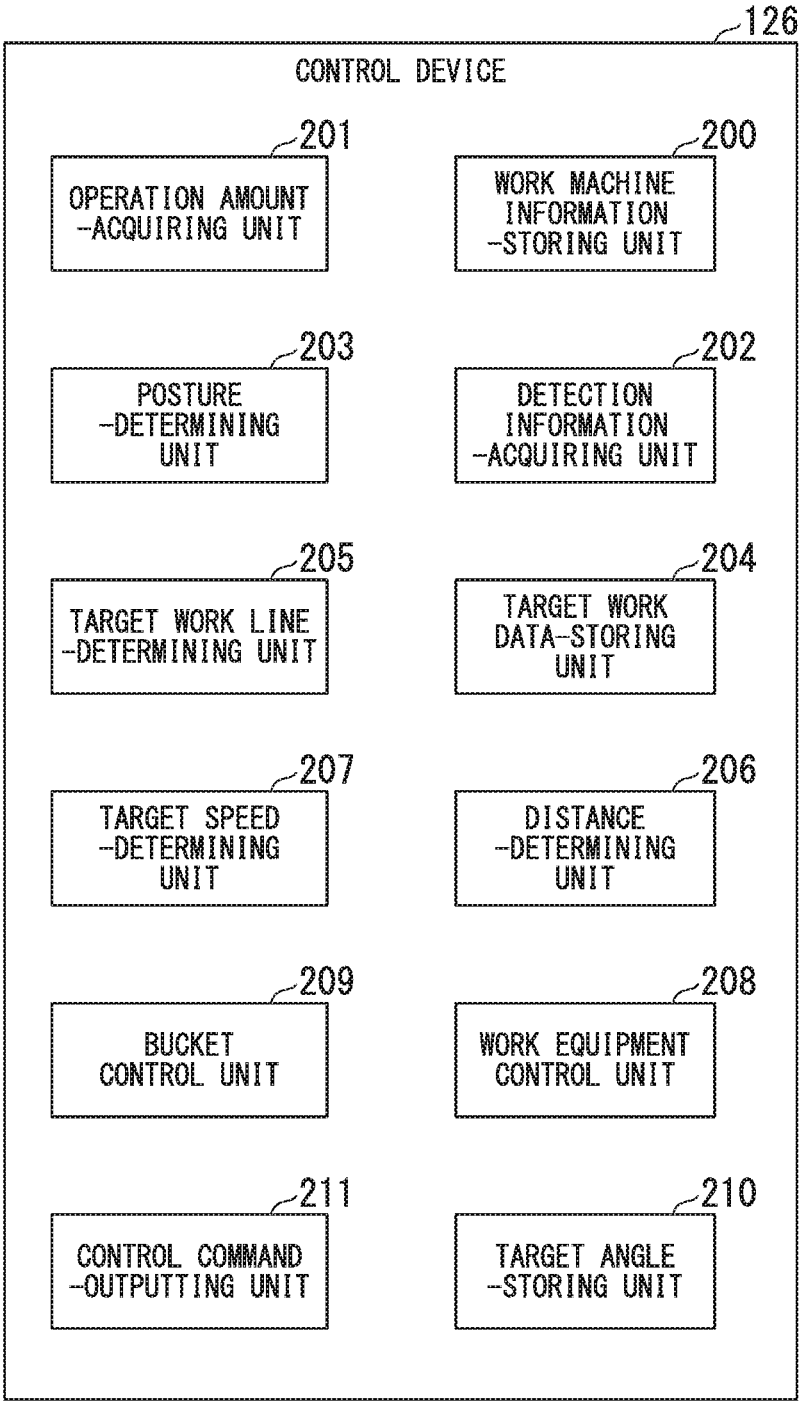
FIG. 4 is a block diagram illustrating a configuration of a control device of the hydraulic shovel according to the first embodiment.

FIG. 4 is a block diagram illustrating a configuration of a control device of the hydraulic shovel according to the first embodiment.

The control device 126 includes a work machine information-storing unit 200, an operation amount-acquiring unit 201, a detection information-acquiring unit 202, a posture-determining unit 203, a target work data-storing unit 204, a target working line-determining unit 205, a distance-determining unit 206, a target speed-determining unit 207, a work equipment control unit 208, a bucket control unit 209, a target angle-storing unit 210, and a control command-outputting unit 211.

The work machine information-storing unit 200 stores the dimension L1 of the boom 111, the dimension L2 of the arm 112, the dimension L3 of the bucket 113, the contour shape of the bucket 113, and the positional relationship between the position of the representative point O of the vehicle body 120 and the pin P1.

The operation amount-acquiring unit 201 acquires an operation signal indicating an operation amount (a pilot hydraulic pressure or an angle of an electric lever) from the operation device 1211. Specifically, the operation amount-acquiring unit 201 acquires an operation amount related to the boom 111, an operation amount related to the arm 112, an operation amount related to the bucket 113, and an operation amount related to swiveling.

The detection information-acquiring unit 202 acquires information detected by each of the position detector 122, the azimuth calculator 123, the gradient detector 124, and the stroke detector 117. Specifically, the detection information-acquiring unit 202 acquires the position information of the vehicle body 120 in the global coordinates, the azimuth in which the vehicle body 120 is directed, the gradient of the vehicle body 120, the length of a stroke of the boom cylinder 114, the length of a stroke of the arm cylinder 115, and the length of a stroke of the bucket cylinder 116.

The posture-determining unit 203 determines the postural angle $\eta$ of the work equipment 110 based on the information acquired by the detection information-acquiring unit 202. Specifically, the posture-determining unit 203 determines the postural angle $\eta$ of the work equipment 110 through the following procedure. The posture-determining unit 203 calculates the postural angle $\alpha$ of the boom 111 from the length of a stroke of the boom cylinder 114. The posture-determining unit 203 calculates the postural angle $\beta$ of the arm 112 from the length of a stroke of the arm cylinder 115. The posture-determining unit 203 calculates the postural angle $\gamma$ of the bucket 113 from the length of a stroke of the bucket cylinder 116.

In addition, the posture-determining unit 203 obtains the bottom surface normal vector Nb based on the calculated postural angle. Specifically, the posture-determining unit 203 obtains the bottom surface normal vector Nb through the following procedure. The posture-determining unit 203 determines the relative positional relationship among three arbitrary points (a point A, a point B, and a point C) of the bucket bottom surface 113A (on the blade tip E side of a curved surface portion of a bottom surface) based on the postural angle $\eta$ of the work equipment 110 expressed as the sum of the postural angles $\alpha$, $\beta$, and $\gamma$, and the contour shape of the bucket 113 stored in the work machine information-storing unit 200. Among these, it is desirable that the point A and the point B be points at both ends of the blade tip of the bucket 113. The posture-determining unit 203 generates two vectors from three determined points. For example, the posture-determining unit 203 generates a vector from the point A toward the point B and a vector from the point A toward the point C. The posture-determining unit 203 adopts the outer product of two generated vectors as the bottom surface normal vector Nb. In addition, the posture-determining unit 203 may obtain the bottom surface normal vector Nb based on the angle of the bucket bottom surface 113A which is determined based on the postural angle $\eta$ of the work equipment 110 and a bucket blade tip angle (an angle formed by a segment connecting the pin P3 and the blade tip E of the bucket 113 to each other and the bucket bottom surface 113A).

The posture-determining unit 203 is an example of a bucket posture-determining unit which determines the angle of the bucket 113.

In addition, the posture-determining unit 203 determines the positions of a plurality of contour points of the bucket 113 in the global coordinates based on the calculated postural angle, information acquired by the detection information-acquiring unit 202, and information stored in the work machine information-storing unit 200. The contour points of the bucket 113 include a plurality of points in a width direction (X-direction) of the blade tip E of the bucket 113 and a plurality of points in the width direction of a bottom plate. Specifically, the posture-determining unit 203 determines the positions of the contour points of the bucket 113 in the global coordinates from the postural angle $\alpha$ of the boom 111, the postural angle $\beta$ of the arm 112, the postural angle $\gamma$ of the bucket 113, the dimension L1 of the boom 111, the dimension L2 of the arm 112, the dimension L3 of the bucket 113, the contour shape of the bucket 113, the positional relationship between the representative point O and the pin P1, the position of the representative point O of the vehicle body 120, the azimuth in which the vehicle body 120 is directed, and the gradient $\theta$ of the vehicle body 120.

The target work data-storing unit 204 stores target work data indicating the target shape of an excavation object on a worksite. The target work data is three-dimensional data expressed in the global coordinates and is stereoscopic topography data or the like constituted of a plurality of triangular polygons which indicate a target working plane. Each triangular polygon constituting target work data shares a side with another triangular polygon adjacent thereto. That is, the target work data indicates a continuous flat plane constituted of a plurality of flat planes. The target work data is stored in the target work data-storing unit 204 by being read from an external storage medium or by being received from an external server via a network.

The target working line-determining unit 205 determines a target working line based on the target work data stored in the target work data-storing unit 204, and the positions of the contour points of the bucket 113 determined by the posture-determining unit 203. The target working line is expressed as a line of intersection between a driving plane of the bucket 113 (a plane which passes through the bucket 113 and is orthogonal to the X-axis) and the target work data. Specifically, the target working line-determining unit 205 determines the target working line through the following procedure.

The target working line-determining unit 205 determines a point at the lowest position (a point having the smallest height) among the contour points of the bucket 113. The target working line-determining unit 205 determines the target working plane positioned vertically below the contour point determined from the target work data. The target working plane defined by the target working line-determining unit 205 may be obtained by a technique or the like for determining a target working plane positioned at the shortest distance with respect to the bucket 113.

Next, the target working line-determining unit 205 calculates the line of intersection between the driving plane of the bucket 113 passing through the determined contour point and the target working plane, and the target work data, as the target working line. When the target work data has an inflection point on the driving plane of the bucket 113, the target working line is constituted of a combination of a plurality of segments. The target working line calculated by the target working line-determining unit 205 may be defined not only as a segment but also in a topographic shape having a width.

The target working line-determining unit 205 is an example of a control reference-determining unit determining a control reference of the work equipment 110.

In addition, the target working line-determining unit 205 determines a normal vector (working plane normal vector Nt) of a target working plane immediately below the bucket 113. The working plane normal vector Nt is expressed in local coordinates of the hydraulic shovel 100 expressed by the X-axis, the Y-axis, and the Z-axis. The working plane normal vector Nt is a vector which is orthogonal to the target working plane and extends to the ground side. Specifically, the target working line-determining unit 205 obtains the working plane normal vector Nt through the following procedure. The target working line-determining unit 205 determines a point at the lowest position among the contour points of the bucket 113. The target working line-determining unit 205 determines the target working plane positioned vertically below the determined contour point. Next, the target working line-determining unit 205 converts the triangular polygon indicating the target working plane into the local coordinates by rotating the triangular polygons indicating the determined target working plane to the same degree as the gradient of the vehicle body acquired by the detection information-acquiring unit 202.

The target working line-determining unit 205 generates two vectors from vertexes (a point D, a point E, and a point F) of the triangular polygon converted into the local coordinates. For example, the posture-determining unit 203 generates a vector from the point D toward the point E and a vector from the point D toward the point F. The posture-determining unit 203 adopts the outer product of two generated vectors as the working plane normal vector Nt. In another embodiment, the target working line-determining unit 205 may rotate a segment immediately below the bucket 113 among the target working lines as much as the gradient of the vehicle body and may adopt a vector which is orthogonal to the segment and extends to the ground side, as the working plane normal vector Nt.

The target working line-determining unit 205 is an example of a working plane-determining unit which determines the angle of a working plane indicating the target shape of an excavation object of the work equipment 110.

The distance-determining unit 206 determines the distance between the bucket 113 and the target working line (excavation object position).

The target speed-determining unit 207 determines the target speed of the boom 111 based on the operation amount of the right side operation lever 1212 in the front-rear direction acquired by the operation amount-acquiring unit 201. The target speed-determining unit 207 determines the target speed of the arm 112 based on the operation amount of the left side operation lever 1213 in the front-rear direction acquired by the operation amount-acquiring unit 201. The target speed-determining unit 207 determines the target speed of the bucket 113 based on the operation amount of the right side operation lever 1212 in the right-left direction acquired by the operation amount-acquiring unit 201.

The work equipment control unit 208 performs work equipment control of controlling the work equipment 110 such that the bucket 113 does not enter into an area lower than the target working line, based on the distance determined by the distance-determining unit 206. The work equipment control according to the first embodiment is control of determining the speed limit of the boom 111 such that the bucket 113 does not enter into an area lower than the target working line, and generating a control command of the boom 111. Specifically, the work equipment control unit 208 determines the speed limit of the boom 111 in a perpendicular direction from the speed limit table indicating a relationship between the distance between the bucket 113 and the excavation object position and the speed limit of the work equipment 110.

Figure 5:
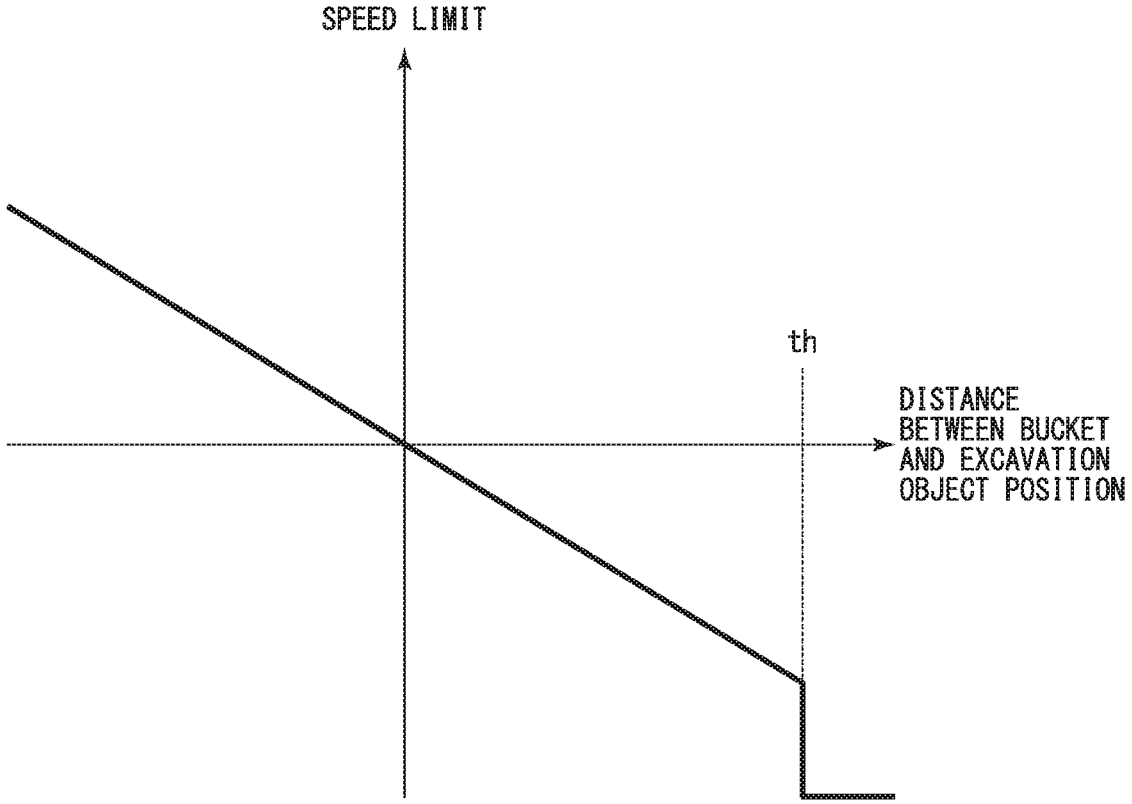
FIG. 5 is a view illustrating an example of a speed limit table.

FIG. 5 is a view illustrating an example of a speed limit table. As illustrated in FIG. 5, according to the speed limit table, when the distance between the bucket 113 and the excavation object position is zero, the speed of the component of the work equipment 110 in the perpendicular direction becomes zero. In the speed limit table, when the lowest point of the bucket 113 is positioned above the target working line, the distance between the bucket 113 and the excavation object position is expressed as a positive value. On the other hand, when the lowest point of the bucket 113 is positioned below the target working line, the distance between the bucket 113 and the excavation object position is expressed as a negative value. In addition, in the speed limit table, the speed at the time the bucket 113 is moving upward is expressed as a positive value. When the distance between the bucket 113 and the excavation object position is equal to or smaller than a work equipment control threshold value th that is a positive value, the speed limit of the work equipment 110 is defined based on the distance between the bucket 113 and the target working line. When the distance between the bucket 113 and the excavation object position is equal to or greater than the work equipment control threshold value th, the absolute value of the speed limit of the work equipment 110 becomes a value greater than the maximum value of the target speed of the work equipment 110. That is, when the distance between the bucket 113 and the excavation object position is equal to or greater than the work equipment control threshold value th, the absolute value of the target speed of the work equipment 110 is smaller than the absolute value of the speed limit at all times. Therefore, the boom 111 is driven at the target speed at all times.

When the absolute value of the speed limit is smaller than the absolute value of the sum of the components of the target speeds of the boom 111, the arm 112, and the bucket 113 in the perpendicular direction, the work equipment control unit 208 calculates the speed limit of the boom 111 in the perpendicular direction by subtracting the component of the target speed of the arm 112 in the perpendicular direction and the component of the target speed of the bucket 113 in the perpendicular direction from the speed limit. The work equipment control unit 208 calculates the speed limit of the boom 111 from the speed limit of the boom 111 in the perpendicular direction.

When a condition for starting bucket control is satisfied, the bucket control unit 209 starts bucket control of controlling the bucket 113 such that the difference between the angles of the bucket bottom surface 113A and the target working plane is maintained at a uniform angle. The difference between the angles of the bucket bottom surface 113A and the target working plane is equivalent to an φ formed by the bottom surface normal vector Nb and the working plane normal vector Nt. When the condition for starting bucket control is satisfied, the bucket control unit 209 causes the target angle-storing unit 210 to store the angle φ formed by the bottom surface normal vector Nb and the working plane normal vector Nt as a target angle. The bucket control unit 209 determines the control speed of the bucket 113 based on the speeds of the boom 111 and the arm 112. The speeds of the boom 111 and the arm 112 are obtained based on the length of a stroke per unit time detected by the stroke detector 117. The condition for starting bucket control according to the first embodiment is a condition in which the distance between the bucket 113 and the excavation object position is smaller than a bucket control-starting threshold value, the operation amount related to the bucket is smaller than a specific threshold value (an angle to an extent corresponding to a play of the operation device 1211), and work equipment control is in execution.

When a condition for ending bucket control is satisfied, the bucket control unit 209 ends bucket control. The condition for ending bucket control according to the first embodiment is a condition in which the distance between the bucket 113 and the excavation object position is equal to or greater than a bucket control-ending threshold value, the operation amount related to the bucket is equal to or greater than the specific threshold value, or work equipment control is not executed. The bucket control-starting threshold value is a value smaller than the bucket control-ending threshold value. The bucket control-starting threshold value is a value equal to or smaller than the work equipment control threshold value th. When work equipment control is not performed due to an operation by an operator, or the like, the bucket control unit 209 does not perform bucket control.

The target angle-storing unit 210 stores the target angle of the angle γ formed by the bottom surface normal vector Nb and the working plane normal vector Nt.

The control command-outputting unit 211 outputs a control command of the boom 111 generated by the work equipment control unit 208 to the electromagnetic proportional control valve of the hydraulic device 125. The control command-outputting unit 211 outputs a control command of the bucket 113 generated by the bucket control unit 209 to the electromagnetic proportional control valve of the hydraulic device 125.

Movement

Here, a method of controlling the hydraulic shovel 100 by the control device 126 according to the first embodiment will be described.

Figure 6:
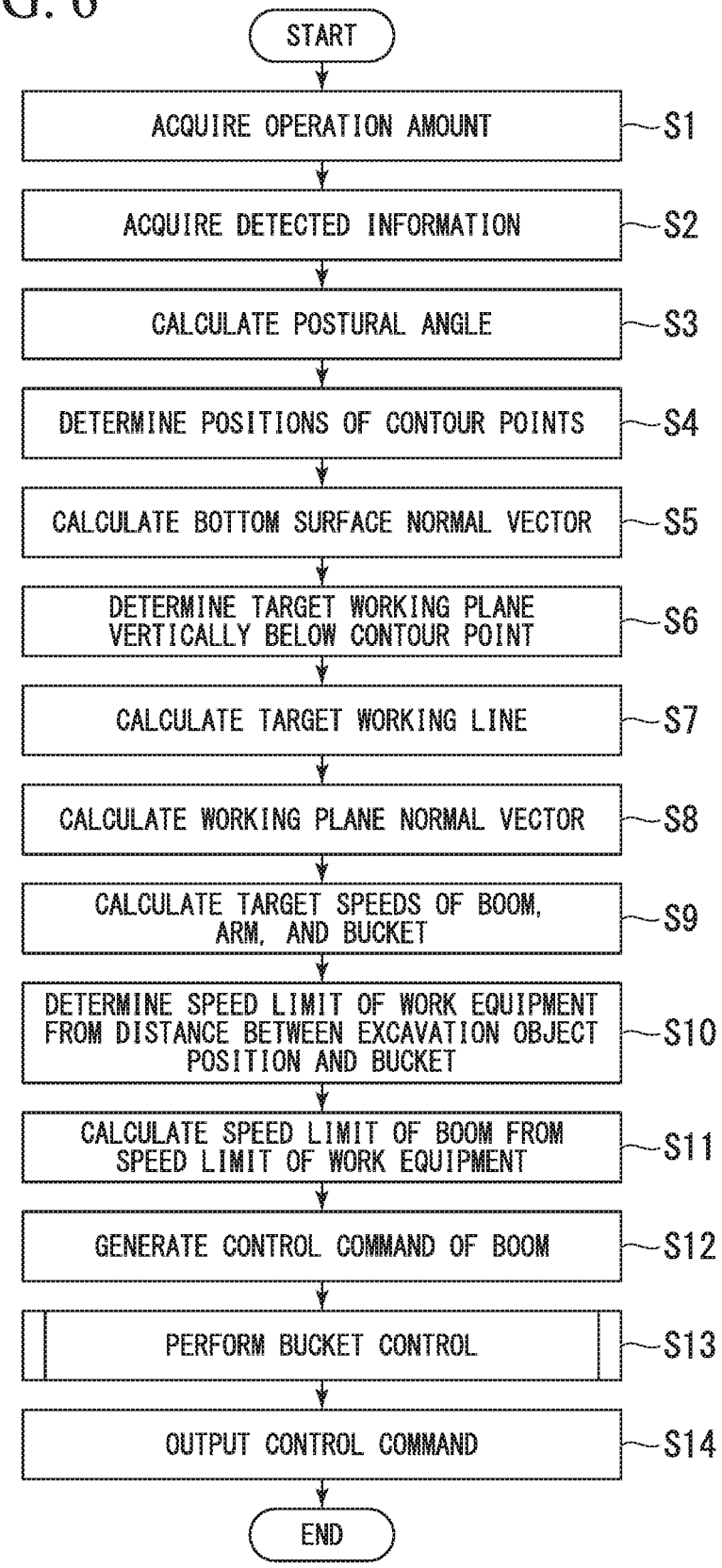
FIG. 6 is a flowchart illustrating a movement of the control device according to the first embodiment.

FIG. 6 is a flowchart illustrating a movement of the control device according to the first embodiment. The control device 126 executes the following control every specific control cycle.

The operation amount-acquiring unit 201 acquires the operation amount related to the boom 111, the operation amount related to the arm 112, the operation amount related to the bucket 113, and the operation amount related to swiveling from the operation device 1211 (Step S1). The detection information-acquiring unit 202 acquires information detected by each of the position detector 122, the azimuth calculator 123, the gradient detector 124, and the stroke detector 117 (Step S2).

The posture-determining unit 203 calculates the postural angle α of the boom 111, the postural angle β of the arm 112, and the postural angle γ of the bucket 113 from the length of a stroke of each hydraulic cylinder (Step S3). The posture-determining unit 203 calculates the positions of the contour points of the bucket 113 in the global coordinates based on the calculated postural angles α, β, and γ; the dimension L1 of the arm 112, the dimension L2 of the bucket 113, the dimension L3 of the boom 111, and the shape of the boom 111 stored in the work machine information-storing unit 200; and the position, the azimuth, and the gradient of the vehicle body 120 acquired by the detection information-acquiring unit 202 (Step S4). In addition, the posture-determining unit 203 calculates the bottom surface normal vector Nb based on the positions of the contour points of the bucket 113 (Step S5).

The target working line-determining unit 205 determines a point of which position in the global coordinates is the lowest position among the contour points of the bucket 113 (Step S6). The target working line-determining unit 205 determines the target working plane positioned vertically below the determined contour point (Step S7). The target working line-determining unit 205 calculates the working plane normal vector Nt of the determined target working plane (Step S8). Next, the target working line-determining unit 205 calculates the line of intersection between the driving plane of the bucket 113 passing through the determined contour point and the target working plane, and the target work data, as the target working line (Step S9). The distance-determining unit 206 determines the distance between the bucket 113 and the excavation object position (Step S10). The target speed-determining unit 207 calculates the target speeds of the boom 111, the arm 112, and the bucket 113 based on the operation amount acquired by the operation amount-acquiring unit 201 Step S1 (Step S11).

Next, the work equipment control unit 208 determines the speed limit of the work equipment 110 associated with the distance between the bucket 113 and the excavation object position which is determined by the distance-determining unit 206 in accordance with the table shown in FIG. 5 (Step S12). Next, the work equipment control unit 208 calculates the speed limit of the boom 111 based on the target speeds of the arm 112 and the bucket 113, and the speed limit of the work equipment 110 (Step S13). The work equipment control unit 208 generates a control command of the boom 111 and a control command of the bucket 113 based on the speed limit of the boom 111 generated by the work equipment control unit 208 (Step S14).

Figure 7:
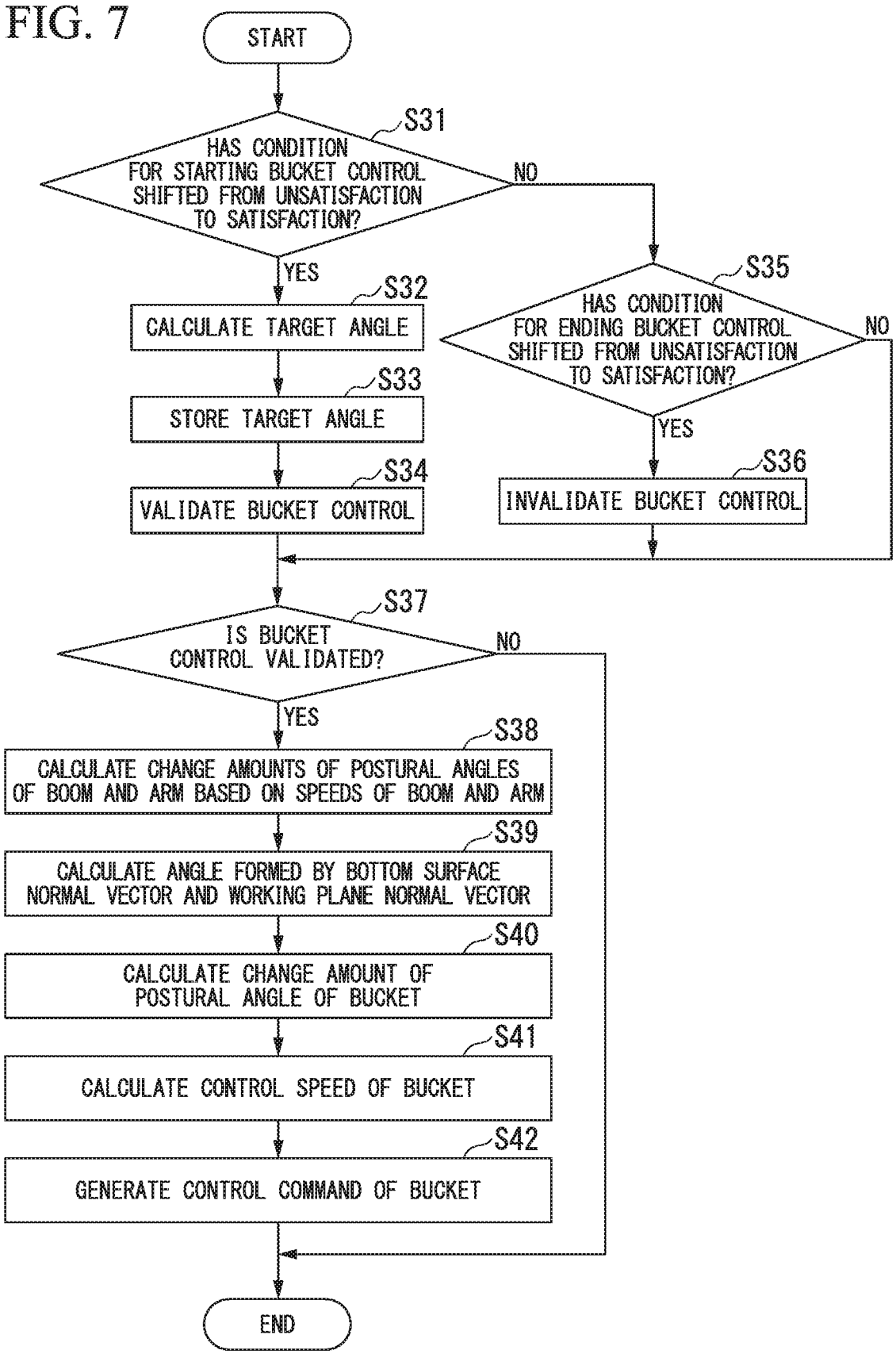
FIG. 7 is a flowchart illustrating processing of bucket control according to the first embodiment.

When the work equipment control unit 208 generates a control command of the boom 111, the bucket control unit 209 performs processing of bucket control as follows (Step S15). FIG. 7 is a flowchart illustrating processing of bucket control according to the first embodiment.

The bucket control unit 209 determines whether or not the state of the hydraulic shovel 100 has shifted from a state of not satisfying the condition for starting bucket control to a state of satisfying the condition thereof, based on the distance determined by the distance-determining unit 206 in Step S10 and the operation amount acquired by the operation amount-acquiring unit 201 in Step S1 (Step S31). When the state of the hydraulic shovel 100 has shifted from a state of not satisfying the condition for starting bucket control to a state of satisfying the condition thereof (Step S31: YES), the bucket control unit 209 calculates the angle φ formed by the bottom surface normal vector Nb determined by the posture-determining unit 203 in Step S5 and the working plane normal vector Nt determined by the target working line-determining unit 205 in Step S8, as the target angle (Step S32). The bucket control unit 209 causes the target angle-storing unit 210 to store the target angle (Step S33). Then, the bucket control unit 209 validates bucket control (Step S34). That is, the bucket control unit 209 determines the control speed of the bucket 113 such that the difference between the angles of the bucket bottom surface 113A and the target working line coincides with the target angle stored in the target angle-storing unit 210 after the condition for starting bucket control is satisfied.

On the other hand, when the state of the hydraulic shovel 100 is a state of not satisfying the condition for starting bucket control, or when the condition has already been satisfied (Step S31: NO), the bucket control unit 209 determines whether or not the state of the hydraulic shovel 100 has shifted from a state of not satisfying the condition for ending bucket control to a state of satisfying the condition thereof (Step S35). When the state of the hydraulic shovel 100 has shifted from a state of not satisfying the condition for ending bucket control to a state of satisfying the condition thereof (Step S35: YES), the bucket control unit 209 invalidates bucket control (Step S36). That is, the bucket control unit 209 no longer determines the control speed of the bucket 113 after the condition for ending bucket control is satisfied.

When bucket control is validated, when bucket control is invalidated, or when there is no shift from unsatisfaction to satisfaction of the condition for starting bucket control and a shift from unsatisfaction to satisfaction of the condition for ending bucket control (Step S35: NO), the bucket control unit 209 determines whether or not bucket control is validated (Step S37). When bucket control is invalidated (Step S37: NO), the bucket control unit 209 ends the processing of bucket control without calculating the control speed of the bucket 113. On the other hand, when bucket control is validated (Step S37: YES), the bucket control unit 209 calculates a change amount $\Delta\alpha$ of the postural angle of the boom 111 and a change amount $\Delta\beta$ of the postural angle of the arm 112 based on the speeds of the boom 111 and the arm 112 (Step S38). In addition, the bucket control unit 209 calculates the angle $\varphi$ formed by the bottom surface normal vector Nb determined by the posture-determining unit 203 in Step S5 and the working plane normal vector Nt determined by the target working line-determining unit 205 in Step S8 (Step S39). Next, the bucket control unit 209 calculates a change amount $\Delta\gamma$ of the postural angle of the bucket 113 by subtracting the angle $\varphi$, the change amount $\Delta\alpha$, and the change amount $\Delta\beta$ calculated in Step S38 from the target angle stored in the target angle-storing unit 210 (Step S40). The bucket control unit 209 calculates the control speed of the bucket 113 by converting the change amount $\Delta\gamma$ into a speed (Step S41). Then, the bucket control unit 209 generates a control command of the bucket 113 based on the control speed of the bucket 113 (Step S42), and ends the processing of bucket control.

When the control device 126 ends the processing of bucket control, the control command-outputting unit 211 outputs a control command of the boom 111 generated by the work equipment control unit 208, and a control command of the bucket 113 generated by the bucket control unit 209 to the electromagnetic proportional control valve of the hydraulic device 125 (Step S16).

Accordingly, the hydraulic device 125 drives the boom cylinder 114, the arm cylinder 115, and the bucket cylinder 116. When bucket control is invalidated, no control command of the bucket 113 is output to the electromagnetic proportional control valve. In this case, the electromagnetic proportional control valve is in an open state allowing a pilot hydraulic pressure to pass through, and the hydraulic device 125 drives the bucket cylinder 116 based on a pilot hydraulic pressure generated by the operation device 1211.

Operations and Effects

Figure 8:
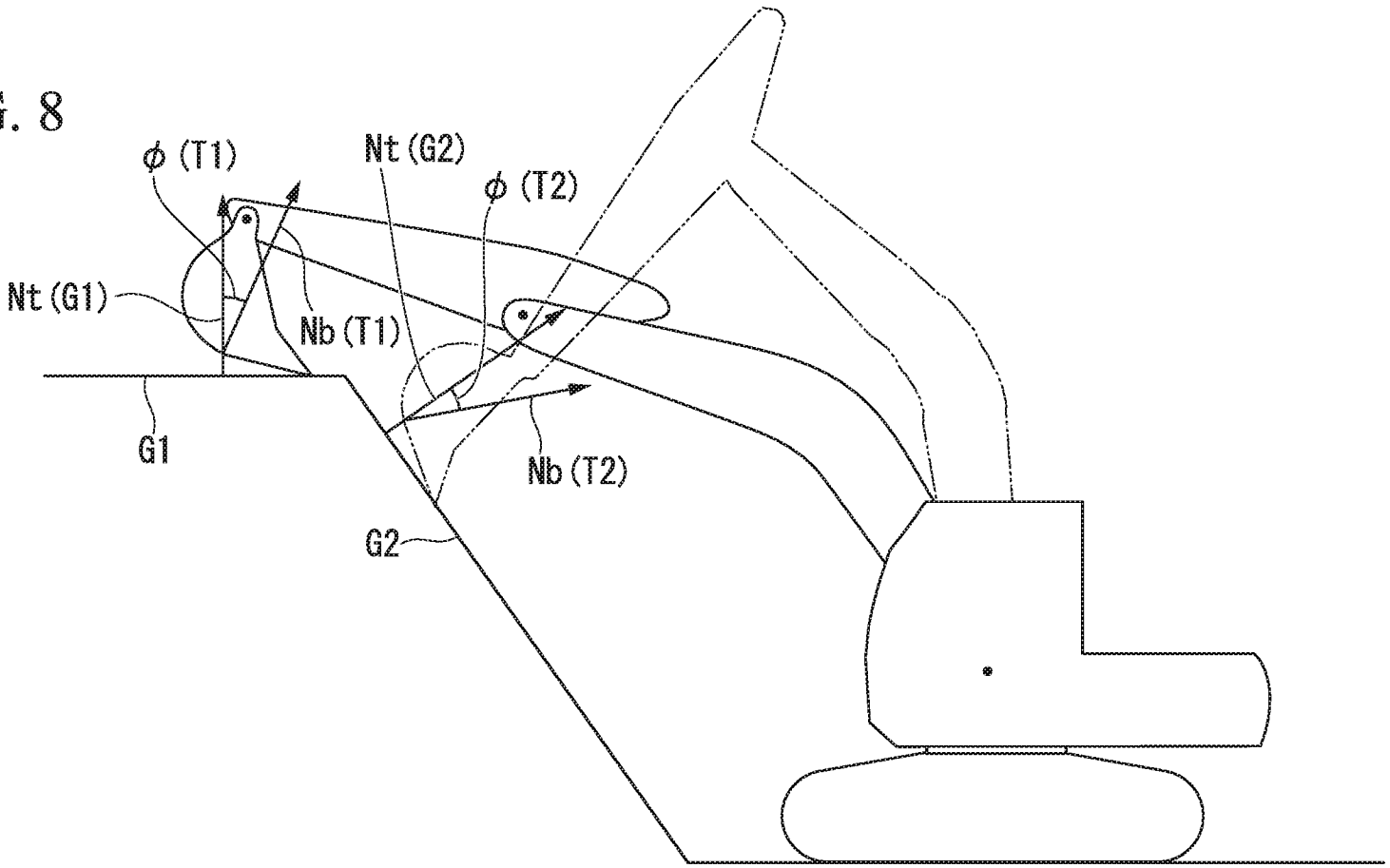
FIG. 8 is a view illustrating an example of a behavior of the hydraulic shovel according to the first embodiment.

FIG. 8 is a view illustrating an example of a behavior of the hydraulic shovel according to the first embodiment. In the example illustrated in FIG. 8, at a time T1, the bucket 113 is positioned above a target working plane G1. Thereafter, the arm 112 is driven in an excavating direction and exceeds an inflection point connecting the target working plane G1 and a target working plane G2 to each other. Then, at a time T2, the bucket 113 moves to a location above the target working plane G2. At the time T1, the control device 126 generates a control command of the bucket 113 such that the angle $\varphi$ (T1) formed by the bottom surface normal vector Nb (T1) and the working plane normal vector Nt (G1) of the target working plane G1 becomes the target angle. Thereafter, at the time T2, the control device 126 generates a control command of the bucket 113 such that the angle $\varphi$ (T2) formed by the bottom surface normal vector Nb (T2) and the working plane normal vector Nt (G2) of the target working plane G2 becomes the target angle.

In this manner, according to the first embodiment, the control device 126 controls the bucket 113 (performs bucket control) such that the difference between the angle of the bucket bottom surface 113A and the angle of the target working plane maintains a uniform angle. Accordingly, even if the bucket 113 exceeds the inflection point and the angle of the target working plane changes, the relative angle between the bucket 113 and the target working plane can be uniformly maintained without an explicit operation performed by an operator.

In addition, according to the first embodiment, the control device 126 controls the bucket 113 such that the difference between the angle of the bucket 113 and the angle of the target working plane maintains the target angle. The target angle in the first embodiment is a difference between the angle of the bucket bottom surface 113A and the angle of the target working plane when the state of the hydraulic shovel 100 satisfies the condition for starting a bucket control. Accordingly, the control device 126 can maintain the relative angle between the bucket bottom surface 113A and the target working plane at an angle intended by an operator. The target angle according to another embodiment does not have to be a difference between the angle of the bucket 113 and the angle of the target working plane when the state of the hydraulic shovel 100 satisfies the condition for starting bucket control. For example, the control device 126 according to another embodiment may be an angle stored in the target angle-storing unit 210 in advance by an operator or the like. For example, the control device 126 can control the bucket 113 such that the bucket bottom surface 113A moves along the target working plane, by storing zero degrees as the target angle in the target angle-storing unit 210.

In addition, according to the first embodiment, the control device 126 performs bucket control when the distance between the bucket 113 and the target working plane is smaller than the bucket control-starting threshold value. When the bucket 113 is sufficiently close to the target working plane, there is high probability that an operator intends to perform finishing excavation of an excavation object. Therefore, the control device 126 can uniformly maintain the angle of the bucket at the time of excavation work without an explicit operation performed by an operator, by performing bucket control when the bucket 113 is sufficiently close to the target working plane. In another embodiment, the condition for starting bucket control does not have to include a condition related to the distance between the bucket 113 and the target working plane. For example, in another embodiment, the condition for starting bucket control may be pressing of a bucket control button (not illustrated).

In addition, according to the first embodiment, when the distance between the bucket 113 and the target working plane is smaller than the work equipment control threshold value th, the control device 126 performs work equipment control of controlling the work equipment 110 such that the bucket 113 does not enter into an area lower than the working plane. At this time, a bucket control threshold value is equal to or smaller than the work equipment control threshold value th. That is, while work equipment control is not executed, bucket control is not executed as well. Within a range in which work equipment control is not executed, there is a high possibility that an operator intends to perform rough excavation and there is a low possibility that an operator intends to perform finishing excavation. Therefore, when the bucket control threshold value is smaller than the work equipment control threshold value th, the control device 126 can be prevented from unnecessarily controlling the angle of the work equipment 110. On the other hand, the control device 126 according to another embodiment does not have to have a function of controlling work equipment. In addition, on the other hand, in the hydraulic shovel 100 according to another embodiment, the bucket control threshold value may be greater than the work equipment control threshold value th.

In addition, according to the first embodiment, when the operation amount related to an operation of the bucket 113 is smaller than the specific threshold value, and when the distance between the bucket 113 and the excavation object position is smaller than the bucket control threshold value, the control device 126 may execute bucket control. When the bucket 113 is operated by the operation device 1211, there is high probability that an operator has an intention of controlling the bucket for himself/herself. Therefore, the control device 126 performs bucket control when the operation amount related to an operation of the bucket 113 is small, so that the angle of the bucket 113 can be prevented from being unnecessarily controlled.

Another Embodiment

Hereinabove, an embodiment has been described in detail with reference to the drawings. However, the specific configuration is not limited to those described above, and various design changes and the like can be performed.

The method of generating an operation signal by the operation device 1211 according to the first embodiment is a PPC method. However, the method is not limited thereto. For example, an electric lever method may be employed. The electric lever method is a method in which an operation signal is generated by detecting operation angles of the right side operation lever 1212 and the left side operation lever 1213 using a potentiometer. In this case, the control device 126 generates a control command of each of the boom 111, the arm 112, and the bucket 113 based on the target speeds of the boom 111, the arm 112, and the bucket 113; the speed limit of the boom 111; and the control speed of the bucket 113. The electromagnetic proportional control valve is controlled in accordance with the generated control commands.

The control device 126 according to the first embodiment determines the difference between the angle of the bucket bottom surface 113A and the angle of the target working plane from the angle φ formed by the bottom surface normal vector Nb and the working plane normal vector Nt. However, another embodiment is not limited thereto. For example, in another embodiment, in place of the bottom surface normal vector Nb, a vector extending from the pin supporting the bucket 113 and the arm 112 to the blade tip of the bucket 113 may be used. In addition, for example, in another embodiment, the difference between the angle of the bucket bottom surface 113A and the angle of the target working plane may be calculated by individually determining the gradient of the bucket bottom surface 113A and the gradient of the working plane.

The condition for starting bucket control according to the first embodiment includes the distance between the bucket 113 and the excavation object position being smaller than the bucket control-starting threshold value. However, the condition is not limited thereto. The condition for starting bucket control need only include a relationship between the state of the work equipment 110 and the control reference of the work equipment satisfying a specific relationship. For example, a condition for starting bucket control according to another embodiment may include the distance between the bucket 113 and the ground level being smaller than the bucket control-starting threshold value, or the like. In this case, the ground level is an example of a control reference.

The control device 126 according to the first embodiment calculates the control speed of the bucket 113 based on the speeds of the boom 111 and the arm 112. However, the calculation is not limited thereto. For example, the control device 126 according to another embodiment may calculate the control speed of the bucket 113 based on the target speeds of the boom 111 and the arm 112, and the speed limit of the boom 111.

The control device 126 according to the first embodiment can be applied to any work machine including work equipment, without being limited to a hydraulic shovel.

INDUSTRIAL APPLICABILITY

According to the embodiments described above, a control device can suitably maintain the angle of a bucket at the time of excavation work straddling an inflection point, without an explicit operation performed by an operator.

REFERENCE SIGNS LIST

100 Hydraulic shovel
111 Boom
112 Arm
113 Bucket
114 Boom cylinder
115 Arm cylinder
116 Bucket cylinder
126 Control device
200 Work machine information-storing unit
201 Operation amount-acquiring unit
202 Detection information-acquiring unit
203 Posture-determining unit
204 Target work data-storing unit
205 Target working line-determining unit
206 Distance-determining unit
207 Target speed-determining unit
208 Work equipment control unit
209 Bucket control unit

210 Target angle-storing unit
211 Control command-outputting unit

The invention claimed is:

1. A work equipment control device which controls a work machine equipped with work equipment including a bucket, the work equipment control device comprising:

a bucket posture-determining unit configured to determine an angle of the bucket;

a working plane-determining unit configured to determine an angle of a working plane indicating a target shape of an excavation object; and a bucket control unit configured to control the bucket such that a difference between the angle of the bucket and an angle of a working plane positioned below the bucket is maintained at a uniform angle even when the bucket is operated across two working planes which are connected and have different gradients.

2. The work equipment control device according to claim 1, wherein the working plane-determining unit is configured to determine the angle of the working plane immediately below the bucket according to three-dimensional data which indicate the working plane.

3. The work equipment control device according to claim 1, wherein the bucket control unit is configured to calculate a difference between the angle of the bucket and the angle of the working plane and control the bucket according to the difference.

4. A work machine, comprising:

work equipment that includes a bucket; and the work equipment control device according to claim 1.

5. The work equipment control device according to claim 1, wherein the bucket posture-determining unit is configured to determine a bottom surface normal vector orthogonal to a bottom surface of the bucket, wherein the working plane-determining unit is configured to determine a working plane normal vector orthogonal to the working plane positioned vertically below the bucket, and wherein the bucket control unit is configured to control the bucket such that an angle formed by the bottom surface normal vector and the working plane normal vector becomes a uniform angle.

6. A work machine, comprising:

work equipment that includes a bucket; and the work equipment control device according to claim 5.

7. The work equipment control device according to claim 5, further comprising:

a distance-determining unit configured to determine a distance between the bucket and the working plane, wherein the bucket control unit is configured to control the bucket such that the difference between the angle of the bucket and the angle of the working plane maintains a uniform angle when the distance between the bucket and the working plane is smaller than a bucket control-starting threshold value.

8. The work equipment control device according to claim 5, wherein the bucket control unit is configured to control the bucket such that the difference between the angle of the bucket and the angle of the working plane becomes the same angle as the difference between the angle of the bucket and the angle of the working plane when a state of the work machine satisfies a specific condition.

9. A work machine, comprising:

work equipment that includes a bucket; and the work equipment control device according to claim 8.

10. The work equipment control device according to claim 8, further comprising:

a distance-determining unit configured to determine a distance between the bucket and the working plane, wherein the bucket control unit is configured to control the bucket such that the difference between the angle of the bucket and the angle of the working plane maintains a uniform angle when the distance between the bucket and the working plane is smaller than a bucket control-starting threshold value.

11. The work equipment control device according to claim 8, further comprising:

a target angle-storing unit configured to store a target value for the difference between the angle of the bucket and the angle of the working plane, wherein the bucket control unit is configured to control the bucket such that the difference between the angle of the bucket and the angle of the working plane maintains the angle stored in the target angle-storing unit.

12. The work equipment control device according to claim 5, further comprising:

a target angle-storing unit configured to store a target value for the difference between the angle of the bucket and the angle of the working plane, wherein the bucket control unit is configured to control the bucket such that the difference between the angle of the bucket and the angle of the working plane maintains the angle stored in the target angle-storing unit.

13. The work equipment control device according to claim 12, further comprising:

a distance-determining unit configured to determine a distance between the bucket and the working plane, wherein the bucket control unit is configured to control the bucket such that the difference between the angle of the bucket and the angle of the working plane maintains a uniform angle when the distance between the bucket and the working plane is smaller than a bucket control-starting threshold value.

14. The work equipment control device according to claim 1, wherein the bucket control unit is configured to control the bucket such that the difference between the angle of the bucket and the angle of the working plane becomes the same angle as a difference between the angle of the bucket and the angle of the working plane when a state of the work machine satisfies a specific condition.

15. The work equipment control device according to claim 14, further comprising:

a target angle-storing unit configured to store a target value for the difference between the angle of the bucket and the angle of the working plane, wherein the bucket control unit is configured to control the bucket such that the difference between the angle of the bucket and the angle of the working plane maintains the angle stored in the target angle-storing unit.

16. The work equipment control device according to claim 14, further comprising:

a distance-determining unit configured to determine a distance between the bucket and the working plane, wherein the bucket control unit is configured to control the bucket such that the difference between the angle of the bucket and the angle of the working plane maintains a uniform angle when the distance between the bucket and the working plane is smaller than a bucket control-starting threshold value.

17. A work machine, comprising:

work equipment that includes a bucket; and the work equipment control device according to claim 14.

18. The work equipment control device according to claim 1, further comprising:

a target angle-storing unit configured to store a target value for the difference between the angle of the bucket and the angle of the working plane, wherein the bucket control unit is configured to control the bucket such that the difference between the angle of the bucket and the angle of the working plane maintains the angle stored in the target angle-storing unit.

19. The work equipment control device according to claim 18, further comprising:

a distance-determining unit configured to determine a distance between the bucket and the working plane, wherein the bucket control unit is configured to control the bucket such that the difference between the angle of the bucket and the angle of the working plane maintains a uniform angle when the distance between the bucket and the working plane is smaller than a bucket control-starting threshold value.

20. A work machine, comprising:

work equipment that includes a bucket; and the work equipment control device according to claim 18.

21. The work equipment control device according to claim 1, further comprising:

a distance-determining unit configured to determine a distance between the bucket and the working plane, wherein the bucket control unit is configured to control the bucket such that the difference between the angle of the bucket and the angle of the working plane maintains a uniform angle when the distance between the bucket and the working plane is smaller than a bucket control-starting threshold value.

22. A work machine, comprising:

work equipment that includes a bucket; and the work equipment control device according to claim 21.

* * * * *